United States Patent [19]

Wilson et al.

[11] Patent Number: 4,560,192

[45] Date of Patent: Dec. 24, 1985

[54] DOOR SECURER

[76] Inventors: Wilfred W. Wilson, 95 Thorncliffe Park Dr., Apt. 4106, Toronto, Ontario, Canada, M4H 1L7; Albert Schlanger, 43 Old Park Rd., Toronto, Ontario, Canada, M6C 3H9

[21] Appl. No.: 440,180

[22] Filed: Nov. 9, 1982

[51] Int. Cl.[4] ..... E05C 17/54

[52] U.S. Cl. ..... 292/339; 248/231.4

[58] Field of Search ..... 292/338, 339, 262, DIG. 15; 70/94; 254/39; 248/231.4, 316.6, 228, 225.3, 289 R, 291; 269/250–253

[56] References Cited

U.S. PATENT DOCUMENTS

| | | | |
|---|---|---|---|
| 467,589 | 1/1892 | Finegan | 254/39 |
| 1,332,473 | 3/1920 | Shirley | 292/339 |
| 1,858,711 | 5/1932 | Lane | 292/338 |
| 1,881,635 | 10/1932 | Johnson | 292/338 |
| 2,170,535 | 8/1939 | Marsden | 269/253 X |
| 2,410,171 | 10/1946 | LeLande | 248/291 X |
| 2,430,366 | 11/1947 | Porterfield | 269/250 X |
| 2,700,949 | 2/1955 | Künzi | 248/291 X |
| 2,774,622 | 12/1956 | Priebe | 292/339 X |
| 4,076,293 | 2/1978 | Valles | 292/338 |
| 4,290,636 | 9/1981 | Steele | 292/338 |
| 4,438,640 | 3/1984 | Willis | 70/94 |

FOREIGN PATENT DOCUMENTS

| | | | |
|---|---|---|---|
| 1019016 | 10/1977 | Canada | 292/339 |

*Primary Examiner*—Gary L. Smith
*Assistant Examiner*—Lloyd A. Gall
*Attorney, Agent, or Firm*—Hirons, Rogers & Scott

[57] ABSTRACT

A door securer includes a generally U-shaped member that is adapted to be mounted on the side of a door that opens, as opposed to the side that is hinged. The inside leg of the U-shaped member is pivotably connected to a leg member that has a foot member pivotably mounted thereon remote from the universal joint. In situ, the leg member extends downwardly from the U-shaped member at an acute angle to the door, and the foot member engages the floor behind the door.

13 Claims, 3 Drawing Figures

DOOR SECURER

BACKGROUND OF THE INVENTION

This invention relates to a device that can be used to prevent unauthorized entry to a room through a door. More particularly, this invention relates to a simple, inexpensive, light, portable door securer that can be used by the travelling public to prevent intruders from entering hotel or motel rooms, for example.

Door securers of various types are known. Reference may be made to U.S. Pat. No. 308,823, W. J. Bitter, issued Dec. 2, 1884, for example. Other forms of door holders, locks or stops are disclosed in the following U.S. Pat. Nos. 2,774,622, issued Dec. 18, 1956, W. A. Priebe; 2,709,615, issued May 31, 1955, W. C. Barnes Jr. et al; 4,198,088, issued Apr. 15, 1980, Joe I. Tochihara; 2,595,709, issued May 6, 1952; H. F. Sands.

Notwithstanding the fact that door securers are known, there still exists a need, which is supplied by the present invention, for a simple, effective, inexpensive, lightweight, portable door securer that can be readily transported in a suitcase, that can be quickly mounted on and detached from the door of a hotel room, motel room or the like and that will positively secure a door on which it is mounted against unauthorized opening.

According to one aspect of this invention there is provided:

A door securer comprising a generally U-shaped member adapted for mounting on the side of the door to be secured that is remote from the side thereof that is hinged to the frame in which the door is mounted, said U-shaped member having a cross-piece and first and second legs upstanding therefrom, in situ said cross-piece bridging the first-mentioned side of the door and said first and second legs being disposed adjacent and in overlapping relation to parts of the front and back respectively of the door; movable apparatus movably mounted on and with respect to said second leg, said movable apparatus being movable into and out of engagement with the part of the back of the door overlapped by said second leg, whereby said movable apparatus is adapted to secure said U-shaped member to the door or release said U-shaped member from the door; a leg member; pivot means pivotably connecting said movable apparatus and said leg member; and a foot member pivotably connected to said leg member at a location remote from said pivot means, whereby, in situ, said leg member projects downwardly from said U-shaped member at an acute angle to the door and said foot member engages the floor behind the door.

BRIEF DESCRIPTION OF THE DRAWINGS

This invention will become more apparent from the following detailed description, taken in conjunction with the appended drawings, in which.

DETAILED DESCRIPTION OF THE INVENTION INCLUDING THE PREFERRED EMBODIMENT

Figure 1:
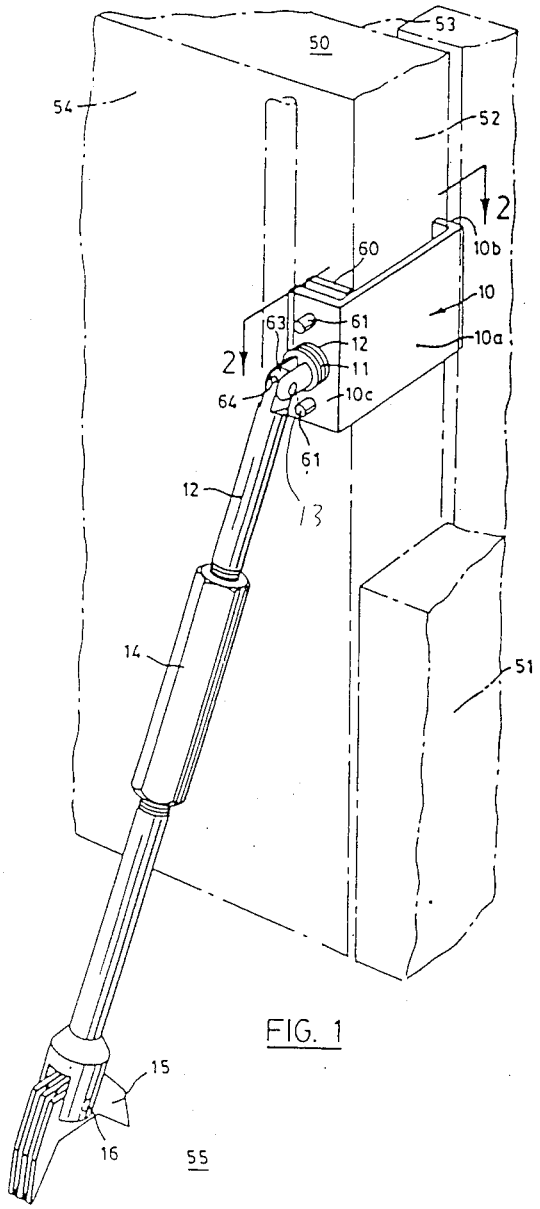
FIG. 1 is a perspective view of a door securer embodying the present invention mounted on a door.

Referring to the drawings, particularly FIG. 1, a door securer embodying the present invention is illustrated and includes a generally U-shaped member 10 having a cross-piece 10*a* and integral legs 10*b* and 10*c* upstanding therefrom, the former being somewhat shorter than the latter.

The door securer is adapted for mounting on the edge of a door 50 to be secured that is remote from the edge of door 50 that is hinged to the door frame 51 in which door 50 is mounted. In other words, the door securer is adapted for mounting on the edge of the door 50 that swings open when door 50 is opened.

When mounted on door 50, cross-piece 10*a* bridges edge 52 of door 50, while legs 10*b* and 10*c* are disposed adjacent and in overlapping relation to parts of the front side 53 and back side 54 respectively of door 50.

The door securer also includes an externally threaded rod 11 that threadably engages internal threads provided around an opening 12 that extends through leg 10*c* and in which rod 11 is mounted. Cooperating with rod 11 is a plate or abutment member 60 made of some material, e.g., a plastics material, that will not damage door 50. Two pins 61 project from one side of plate 60 and slide in two openings provided in leg 10*c*. By turning rod 11 in one direction, U-shaped member 10 can be securely fastened to door 50 by virtue of plate 60 being butted against door 50 by rod 11. It can be readily released from door 50 by turning rod 11 in the opposite direction. It will be appreciated, of course, that many other different types of mechanisms or movable apparatus may be used in place of rod 11, plate 60 and pins 61 to removably fasten U-shaped member 10, and, hence, the door securer, to door 50.

The door securer also includes a leg member 12 pivotably connected by means of a pivot pin 13 to one end of the movable apparatus, specifically to rod 11. Preferably the length of leg 12 is adjustable. In the preferred embodiment this is achieved by means of a turnbuckle 14 incorporated in leg 12.

Finally, the door securer includes a foot member 15 that is pivotably connected to leg 12 at the end thereof opposite to the end that is connected to pin 13. As best shown in FIG. 1, the nature of the pivotable connection of foot member 15 to leg 12 is such that, in situ, the pivot axis 16 is parallel to the floor, designated 55, and parallel to door 50 when it is in the closed position.

As best shown in FIG. 1, in use leg 12 projects downwardly from U-shaped member 10 at an acute angle to door 50, and foot member 15 engages floor 55 behind door 50. To this end, foot member 15 has one or more pointed projections to positively engage floor 55.

To install the door securer, door 50 is opened and U-shaped member 10 is positioned on the appropriate side of door 50 at a location above floor 55 that is spaced from floor 55 by a distance less than the length of leg 12 and which will result in leg 12 being inclined at, say, approximately 45° to door 50 when door 50 is closed and foot member 15 is brought into engagement with floor 55. U-shaped member 10 is secured to door 50 in this position by turning rod 11 until plate 60 securely engages back 54 of door 50. Note that this can be accomplished readily by inclining leg 12 at an angle to rod 11 and turning leg 12. Door 50 then is closed and foot member 16 engaged with floor 55 behind door 50. Any necessary adjustments in the length of leg 12 can be made by turnbuckle 14.

Any attempt to open door 50 from the outside will be resisted strongly by the door securer. Note that any inward force on door 50 will cause door 50 to be moved upwardly against the top of frame 51.

Figure 2:
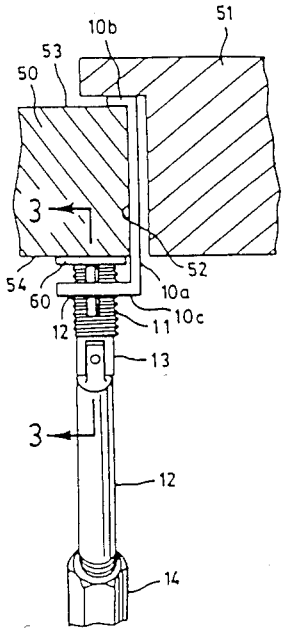
FIG. 2 is a section taken along line 2—2 in FIG. 1.
Figure 3:
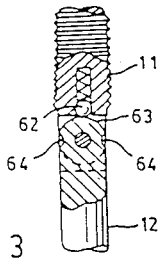
FIG. 3 is a section taken along line 3—3 in FIG. 2.

As best shown in FIG. 2, the length of leg 10*b* preferably is less than the depth of the door stop 56 on frame 51, so that door stop 56 covers and conceals leg 10*b*. This is not essential, however, since any attempt to pry off U-shaped member 10 from door 50 would be inhibited by cross-piece 10*a* bearing against frame 51.

All components of the door securer except plate 60 preferably are made of a strong metal, e.g., steel, although plate 60 may be plastic coated steel, for example.

In the preferred embodiment of the invention means are provided to hold leg 12 in an upwardly extending, inoperative position so that door 50 can be opened and closed in a normal manner. In the preferred embodment this result is accomplished by means of a spring loaded ball 62 that rides on the end surface 63 of leg 12 and that is engageable in detents 64 provided in end surface 63. When leg 12 is moved upwardly from the position shown in FIG. 1, pivoting about pivot pin 13, to a position substantially parallel to door 50, ball 62 engages one of detents 64 and holds leg 12 in that position.

While a preferred embodiment has been described and illustrated herein, a person skilled in the art will appreciate that changes and modifications may be made therein without departing from the spirit and scope of this invention as defined in the appended claims.

What I claim is:

1. A door securer for attachment to an edge of a door to inhibit movement thereof in a predetermined direction, said securer comprising a bracket having a pair of spaced arms to receive a door therebetween, a clamp member adjustably mounted on one of said arms to be moveable relative to the other of said arms to clamp the door therebetween, and a brace connected to said clamp member and engagable with a surface to inhibit said movement, said clamp member including a threaded shaft received within threaded aperture in said one arm and rotatable relative thereto to induce movement therebetween and an abutment member located at one end of said shaft to be moved toward said other arm upon rotation of said shaft, said brace being pivotally connected to the other end of said shaft and swingable relative to said shaft through the axis of rotation of said shaft from a stored position in which said brace extends generally perpendicular to the axis of rotation of said shaft to an operative position in which said brace is inclined ot the axis of rotation.

2. A door securer according to claim 1 wherein said abutment member comprises a movable plate engageable by said threaded member and slidably supported on said one arm.

3. A door securer according to claim 2 wherein said brace includes a leg, means for adjusting the length of said leg, and a foot member pivotably connected to said leg about an axis perpendicular to the axis of rotation of said shaft.

4. A door securer according to claim 3 wherein said adjusting means is a turnbuckle incorporated in said leg.

5. A door securer according to claim 1 including means for adjusting the length of said brace.

6. A door securer according to claim 5 wherein said adjusting means is a turnbuckle incorporated in said brace.

7. A door securer according to claim 1 wherein said brace includes a foot member pivotably adjustable for engagement with a floor in the operative position.

8. A door securer according to claim 7 wherein said foor comprises a plurality of elements each having pointed projections.

9. A door securer according to claim 1 including means for holding said brace in said stored position.

10. A door securer accordng to claim 9 wherein said means for holding the brace in said stored position comprises a detent acting between said brace and said shaft.

11. A door securer according to claim 1 wherein the length of said other arm is less than the length of said one arm to facilitate the door stop on the frame in which the door is to be mounted covering and concealing said other arm.

12. A door securer according to claim 1 wherein the length of said other arm is less than the depth of the door stop on the frame in which the door is mounted, whereby, in situ, the door stop covers and conceals said other arm.

13. A door securer according to claim 1 wherein said brace is pivotally connected to the other end of said shaft by a pin to restrict relative pivotal movement to a single axis.

* * * * *